US009263794B2

(12) United States Patent
Stjernman

(10) Patent No.: US 9,263,794 B2
(45) Date of Patent: Feb. 16, 2016

(54) NODE IN A WIRELESS COMMUNICATION NETWORK WITH AT LEAST TWO ANTENNA COLUMNS

(75) Inventor: Anders Stjernman, Lindome (SE)

(73) Assignee: TELEFONAKTIEBOLAGET L M ERICSSON (PUBL), Stockholm (SE)

( * ) Notice: Subject to any disclaimer, the term of this patent is extended or adjusted under 35 U.S.C. 154(b) by 57 days.

(21) Appl. No.: 14/364,983

(22) PCT Filed: Dec. 13, 2011

(86) PCT No.: PCT/EP2011/072504

§ 371 (c)(1),
(2), (4) Date: Jun. 12, 2014

(87) PCT Pub. No.: WO2013/087091

PCT Pub. Date: Jun. 20, 2013

(65) Prior Publication Data

US 2014/0347248 A1 Nov. 27, 2014

(51) Int. Cl.

| | |
|---|---|
| ***H01Q 21/00*** | (2006.01) |
| ***H01Q 1/50*** | (2006.01) |
| ***H01Q 1/24*** | (2006.01) |
| ***H01Q 3/30*** | (2006.01) |
| ***H01Q 21/24*** | (2006.01) |

(Continued)

(52) U.S. Cl.

CPC ..... *H01Q 1/50* (2013.01); *H01Q 1/246* (2013.01); *H01Q 1/52* (2013.01); *H01Q 3/30* (2013.01); *H01Q 15/24* (2013.01); *H01Q 21/24* (2013.01)

(58) Field of Classification Search

CPC ..... H01Q 1/50; H01Q 1/52; H01Q 15/24
See application file for complete search history.

(56) References Cited

U.S. PATENT DOCUMENTS

| | | | | |
|---|---|---|---|---|
| 6,509,883 | B1 * | 1/2003 | Foti | H01P 1/161 343/850 |
| 7,259,642 | B2 * | 8/2007 | Kirino | H01P 1/181 333/100 |
| 8,279,132 | B2 * | 10/2012 | Jung | H01Q 1/246 343/853 |

(Continued)

FOREIGN PATENT DOCUMENTS

| | | |
|---|---|---|
| WO | 2011095184 A1 | 8/2011 |
| WO | 2011103919 A1 | 9/2011 |

OTHER PUBLICATIONS

Office Action dated Jun. 25, 2015, issued in Chinese Patent Application No. 201180075515.2, 6 pages.

*Primary Examiner* — Trinh Dinh
(74) *Attorney, Agent, or Firm* — Rothwell, Figg, Ernst & Manbeck, P.C.

(57) ABSTRACT

A node in a wireless communication network, the node comprising at least two antenna columns which are physically separated from each other, each antenna column comprising at least one dual polarized antenna element. Each antenna element has a first polarization and a second polarization. The node further comprises at least two four-port power dividers/combiners, each power divider/combiner having a first port pair and a second port pair, where, for each power divider/combiner, power input into any port in a port pair is isolated from the other port in said port pair, but divided between the ports in the other port pair. Antenna ports of antenna columns that are pair-wise physically separated, from those pairs of antenna columns that are most physically separated to those that are least physically separated, are cross-wise connected to the first port pair in corresponding power dividers/combiners.

8 Claims, 4 Drawing Sheets

(51) Int. Cl.
*H01Q 1/52* (2006.01)
*H01Q 15/24* (2006.01)

(56) References Cited

U.S. PATENT DOCUMENTS

2005/0030249 A1* 2/2005 Gabriel ..... H01Q 19/17 343/853
2007/0205955 A1* 9/2007 Korisch ..... H01Q 1/246 343/853
2012/0007789 A1* 1/2012 Petersson ..... H01Q 21/24 343/876
2012/0068907 A1* 3/2012 Petersson ..... H01Q 25/02 343/853
2012/0319900 A1* 12/2012 Johansson ..... H01Q 1/246 342/368
2012/0319920 A1* 12/2012 Athley ..... H01Q 3/30 343/853

* cited by examiner

NODE IN A WIRELESS COMMUNICATION NETWORK WITH AT LEAST TWO ANTENNA COLUMNS

CROSS REFERENCE TO RELATED APPLICATION(S)

This application is a 35 U.S.C. §371 National Phase Entry Application from PCT/EP2011/072504, filed Dec. 13, 2011, designating the United States, the disclosure of which is incorporated herein in its entirety by reference.

TECHNICAL FIELD

The present invention relates to a node in a wireless communication network. The node comprises at least two antenna columns which are physically separated from each other. Each antenna column comprises at least one dual polarized antenna element, each antenna element having a first polarization and a second polarization, the first polarization and second polarization being mutually orthogonal. In this way, each antenna column comprises a first antenna port, associated with the first polarization, and a second antenna port, associated with the second polarization.

BACKGROUND

A node in a wireless communication network mostly comprises at least one antenna arrangement. Such antenna arrangements are in many cases adapted for at least one of beam tilt in elevation, beam tilt in azimuth and adjustable beam width. However, for antennas with orthogonally dual polarized antenna elements, it is desirable that the orthogonality is maintained when the antenna beam or antenna beams are changed.

WO 2011/095184 discloses an antenna system with two ports arranged for dual polarized beam forming with interleaved elements in antenna arrays. It is shown how antenna elements with odd number in columns with odd number and antenna elements with even number in columns with even number are connected to one network, and how the remaining antenna elements, i.e. even antenna elements in odd columns and odd antenna elements in even columns with another network.

The feeding of interleaved antenna arrays leads to many problems such as grating lobes or high coupling between the antenna elements. Using lossless distribution networks will lead to reflection and coupling between ports connected to antenna side. Those reflections will in turn lead high to standing wave patterns and losses in the cables connecting different parts of the feeding networks at certain frequencies depending on the total path length in the networks. This easily deteriorates the achieved antenna patterns.

Also, since the feeding networks are disjoint, explicit care must be taken in adjusting the required phase shifters so that orthogonal patterns are achieved in every direction.

There is thus a need for a node in a wireless communication network which comprises at least one mobile communication dual polarized antenna where the orthogonality between its polarizations is maintained when the antenna beam or antenna beams are changed without the disadvantages of prior art arrangements.

SUMMARY

The object of the present invention is to obtain a node in a wireless communication network which comprises at least one mobile communication dual polarized antenna where the orthogonality between its polarizations is maintained when the antenna beam or antenna beams are changed without the disadvantages of prior art arrangements.

This object is obtained by means of a node in a wireless communication network. The node comprises at least two antenna columns which are physically separated from each other. Each antenna column comprises at least one dual polarized antenna element, each antenna element having a first polarization and a second polarization, the first polarization and second polarization being mutually orthogonal. In this way, each antenna column comprises a first antenna port, associated with the first polarization, and a second antenna port, associated with the second polarization.

The node further comprises at least two four-port power dividers/combiners, each power divider/combiner having a first port pair and a second port pair. For each power divider/combiner, power input into any port in a port pair is isolated from the other port in said port pair, but divided between the ports in the other port pair. Antenna ports of antenna columns that are pair-wise physically separated, from those pairs of antenna columns with antenna columns that are most physically separated to those pairs of antenna columns with antenna columns that are least physically separated, in a falling order, are cross-wise connected to the first port pair in corresponding power dividers/combiners. By means of this arrangement, each first port pair is associated with orthogonal polarizations of different antenna columns.

Furthermore, for at least one power divider/combiner, the ports in the second port pair are connected to a corresponding second phase altering device and third phase altering device, the phase altering devices that are connected to a certain power divider/combiner constituting a set of phase altering devices. One port in each second port pair is connected to a first power dividing/combining network and the other port in each second port pair is connected to a second power dividing/combining network, each power dividing/combining network having a respective main input/output port.

According to an example, one port in the first port pair that is associated with a certain polarization is connected to the corresponding antenna port via a first phase altering device, the phase altering devices that are connected to a certain power divider/combiner constituting a set of phase altering devices.

According to another example, the antenna columns have respective main extensions in an elevation direction.

Then the antenna columns may be separated in either an azimuth direction or the elevation direction, the azimuth direction and the elevation direction being mutually orthogonal.

Alternatively, the antenna columns may be arranged in at least two aligned rows, each row extending in an azimuth direction and having the same number of antenna columns, the rows being separated from each other in the elevation direction, the azimuth direction and the elevation direction being mutually orthogonal.

Other examples are disclosed in the dependent claims.

A number of advantages are obtained by means of the present invention compared to prior art arrangements. For example,

- the elements can be placed in a sparser grid since each element are excited with both ports, leading to fewer number of required components for the same functionality and also possibility to reduce the coupling between elements and column; and coupling between the output ports are reduced and also the effect of inter element coupling is reduced due to the regular shape of the array.

BRIEF DESCRIPTION OF THE DRAWINGS

The present invention will now be described more in detail with reference to the appended drawings, where.

DETAILED DESCRIPTION

Figure 2:
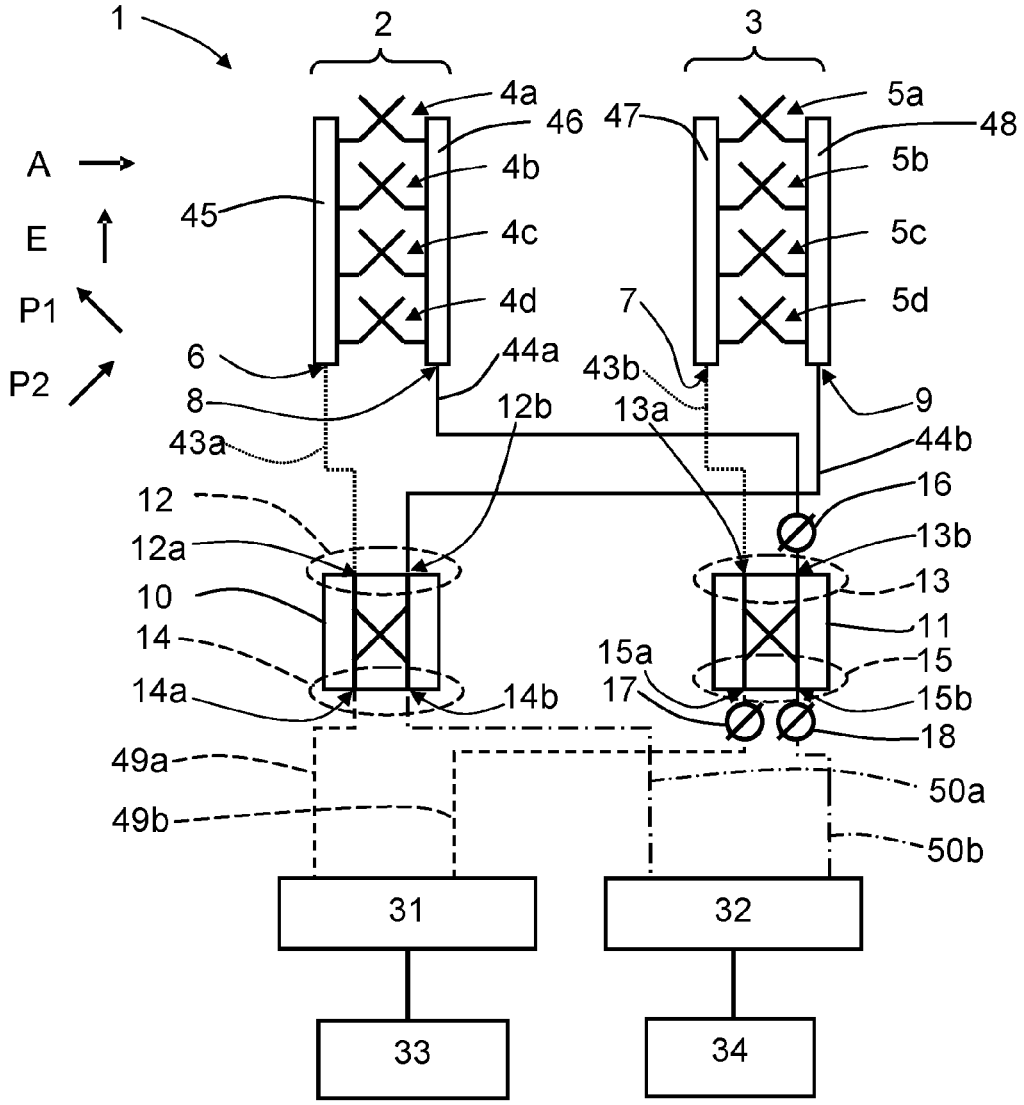
FIG. 2 shows a node according to the present invention with two antenna columns in a row.

With reference to FIG. 2, there is a node 1 in a wireless communication network. The node 1 comprises two antenna columns 2, 3, a first antenna column 2 and a second antenna column 3, which antenna columns 2, 3 are physically separated from each other in an azimuth direction A. Each antenna column 2, 3 comprises four dual polarized antenna elements 4*a*, 4*b*, 4*c*, 4*d*; 5*a*, 5*b*, 5*c*, 5*d* which extend in an elevation direction E, along the longitudinal extension of each antenna column 2, 3. The azimuth direction A elevation direction E are orthogonal to each other.

The antenna columns 2, 3 are arranged to radiate or receive by means of a main lobe, which, as will be described below, is controllable.

Each dual polarized antenna element 4*a*, 4*b*, 4*c*, 4*d*; 5*a*, 5*b*, 5*c*, 5*d* is arranged for transmission and reception of a first polarization P1 and a second polarization P2, where the first polarization P1 and the second polarization P2 are mutually orthogonal. Each antenna column 2, 3 comprises a corresponding first antenna port 6, 7, associated with the first polarization P1, and a second antenna port 8, 9, associated with the second polarization P2.

In other words, the first antenna column 2 comprises a first antenna port 6, connected to the first polarization P1 of its antenna elements 4*a*, 4*b*, 4*c*, 4*d* via a first column first distribution network 45; and a second antenna port 8, connected to the second polarization P2 of its antenna elements 4*a*, 4*b*, 4*c*, 4*d* via a first column second distribution network 46.

In the same way, the second antenna column 3 comprises a first antenna port 7, connected to the first polarization P1 of its antenna elements 5*a*, 5*b*, 5*c*, 5*d* via a second column first distribution network 47; and a second antenna port 9, connected to the second polarization P2 of its antenna elements 5*a*, 5*b*, 5*c*, 5*d* via a second column second distribution network 48.

The distribution networks 45, 46, 47, 48 are in this example constituted by identical or at least similar elevation networks.

According to the present invention, the node 1 further comprises two four-port hybrids 10, 11, each four-port hybrid 10, 11 having a first port pair 12, 13 and a second port pair 14, 15. This means that the node 1 comprises a first hybrid 10, having a first port pair 12 and a second port pair 14, and that the node further comprises a second hybrid 11, having a first port pair 13 and a second port pair 15.

Each power hybrid 10, 11 functions such that power input into any port in a port pair is isolated from the other port in said port pair, but divided between the ports in the other port pair, in this example equally divided. As an example, ideally, power input into a first port 12*a* of the first port pair 12 of the first hybrid 10 divides equally between the ports 14*a*, 14*b* in the second port pair 14 of the first hybrid 10, but none of the input power is output from the second port 12*b* of the first port pair 12 of the first hybrid 10.

Figure 1:
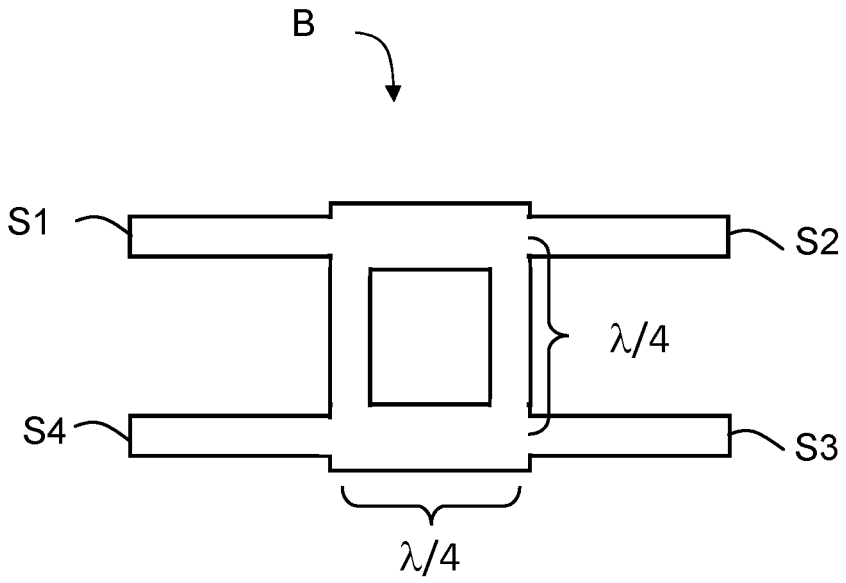
FIG. 1 shows a branch-line directional coupler.

An example of such a hybrid, in the form of a so-called branch-line coupler B, is shown in FIG. 1. Here there is a first port S1, a second port S2, a third port S3 and a fourth port S4. The first port S1 and the second port S2 form a first port pair, and the third S3 and the fourth port S4 form a second port pair. The ports are connected with conductors running in a square, the ports being formed in the corners of the square. The electrical length between two adjacent ports is $\lambda/4$, which corresponds to a phase length of 90°. $\lambda$ refers to the wavelength in the present material.

Since the wavelength changes with frequency, it should be understood that hybrids of this sort are designed for a certain frequency band, having a certain bandwidth, being designed around a certain center frequency. The center frequency is used for calculating the wavelength $\lambda$ in order to obtain the electrical length $\lambda/4$.

Thus power that is input into a port in a port pair, such as the first port S1, is divided equally between the ports S3, S4 in the other port pair while none of the input power is output from the second port S2. This is due to the fact that the input signal travel from the first port S1 to the second port S2 two different paths, and arrive at the second port with a mutual phase difference of 180° which leads to cancellation.

The antenna ports 6, 8; 7, 9 of the antenna columns 2, 3 are cross-wise connected to the first port pair 12, 13 in corresponding power dividers/combiners 10, 11, such that each first port pair 12, 13 is associated with orthogonal polarizations P1, P2 of different antenna columns 2, 3.

More in detail, the first antenna port 6 of the first antenna column 2, and the second antenna port 9 of the second antenna column 3 are connected to the first port pair 12 of the first hybrid 10. Furthermore, the second antenna port 8 of the first antenna column 2, and the first antenna port 7 of the second antenna column 3 are connected to the first port pair 13 of the second hybrid 11. The first antenna ports 6, 7, associated with the first polarization P1, are connected to the respective hybrid 10, 11 by means of connections 43*a*, 43*b* that are indicated with respective dotted lines. The second antenna ports 8, 9, associated with the second polarization P2, are connected to the respective hybrid 10, 11 by means of connections 44*a*, 44*b* that are indicated with respective solid lines.

The second antenna port 8 of the first antenna column 2 is connected to the second hybrid 11 via a first phase altering device 16.

Furthermore, the first port 14*a*, 15*a* in each second port pair 14, 15 is connected to a first power dividing/combining network 31 via respective connections 49*a*, 49*b* that are indicated with dashed lines. In the same way, the second port 14*b*, 15*b* in each second port pair 14, 15 is connected to a second power dividing/combining network 32 via respective connections 50*a*, 50*b* that are indicated with dashed-dotted lines.

The power dividing/combining networks 31, 32 are of the type two-to-one, having a respective main input/output port 33, 34.

Furthermore, the ports 15*a*, 15*b* of the second port pair 15 of the second hybrid are connected to the respective power dividing/combining networks 31, 32 via a corresponding second phase altering device 17 and third phase altering device 18.

The phase altering devices 16, 17, 18 are controllable and the first phase altering device 16 is settable to a first phase value $\alpha_1$, the second phase altering device 17 is settable to a second phase value $\beta_{12}$ and the third phase altering device 18 is settable to a third phase value $\beta_{22}$. By means of the second phase altering device 17 and the third phase altering device 18, the main lobe pointing direction and lobe width may be altered, and by means of the first phase altering device 16, orthogonality is preserved in all directions.

In order to achieve this, the first phase value $\alpha_1$ is adjusted to be the sum of the second phase value $\beta_2$ and the third phase value $\beta_{22}$.

The phase altering devices 16, 17, 18 constitute a set of phase altering devices.

Figure 3:
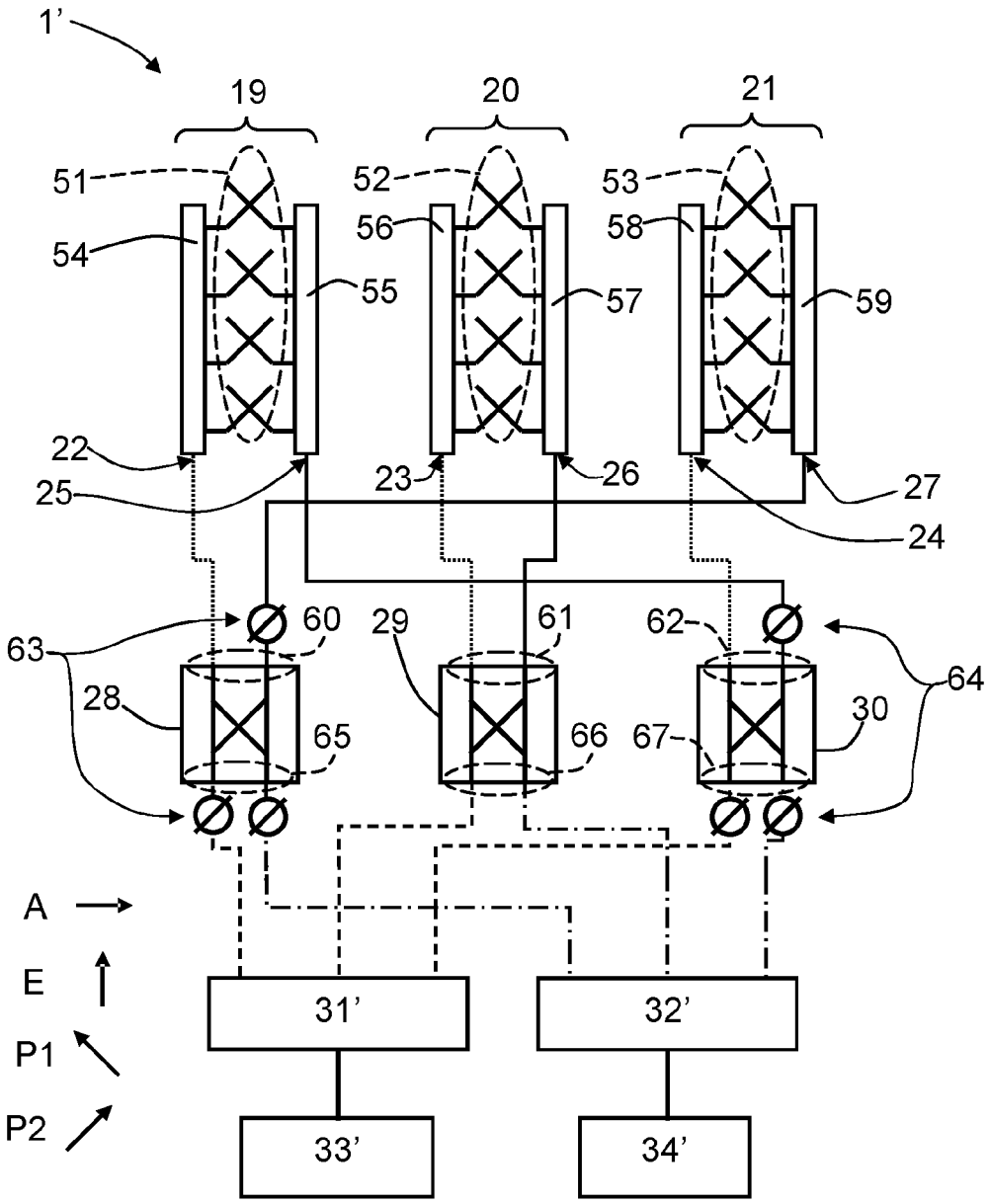
FIG. 3 shows a node according to the present invention with three antenna columns in a row.

With reference to FIG. 3, a second example will be described, and although not all details will be described as thoroughly as above with reference to FIG. 1, it should be understood that the connections are similar in this example.

Here a node 1' comprises a first antenna column 19, a second antenna column 20 and a third antenna column 21, the antenna columns 19, 20, 21 being oriented in the same way as in FIG. 1, and each antenna column 19, 20, 21 comprising four dual polarized antenna elements 51, 52, 53 that are connected to corresponding first and second antenna ports 22,25; 23, 26; 24, 27 via corresponding distribution networks 54, 55, 56, 57, 58, 59. The antenna ports 22,25; 23, 26; 24, 27 are cross-wise connected to first port pairs 60, 61, 62 in a corresponding first hybrid 28, second hybrid 29 and third hybrid 30, such that each first port pair 60, 61, 62 is associated with orthogonal polarizations P1, P2 of different antenna columns 19, 20, 21.

Here, in the case of an odd number of antenna columns 19, 20, 21, the antenna ports 23, 26 of the central antenna column 20 are connected to the same power divider/combiner 29 in order to maintain the symmetry of the connections that is evident for all examples.

More in detail, the first antenna port 22 of the first antenna column 19, and the second antenna port 27 of the third antenna column 21 are connected to the first port pair 60 of the first hybrid 28. Furthermore, the second antenna port 25 of the first antenna column 19 and the first antenna port 24 of the third antenna column 21 are connected to the first port pair 62 of the third hybrid 30. Finally, the first antenna port 23 and the second antenna port 26 of the second antenna column 20 are connected to the first port pair 61 of the second hybrid 29.

The first antenna ports 22, 23, 24, associated with the first polarization P1, are connected to the respective hybrid 28, 29, 30 by means of connections that are indicated with respective dotted lines. The second antenna ports 25, 26, 27, associated with the second polarization P2, are connected to the respective hybrid 28, 29, 30 by means of connections that are indicated with respective solid lines.

The first hybrid 28 and the third hybrid 30 are each equipped with a set 63, 64 of phase altering devices in the same way as for the second hybrid 11 in the previous example.

Furthermore, one port in corresponding second port pairs 65, 66, 67 of the hybrids 28, 29, 30 are connected to a first power dividing/combining network 31' via respective connections that are indicated with dashed lines. In the same way, the other port in the corresponding second port pairs 65, 67, 68 are connected to a second power dividing/combining network 32' via respective connections that are indicated with dashed-dotted lines.

The power dividing/combining networks 31', 32' are of the type three-to-one, having a respective main input/output port 33', 34'.

Figure 4:
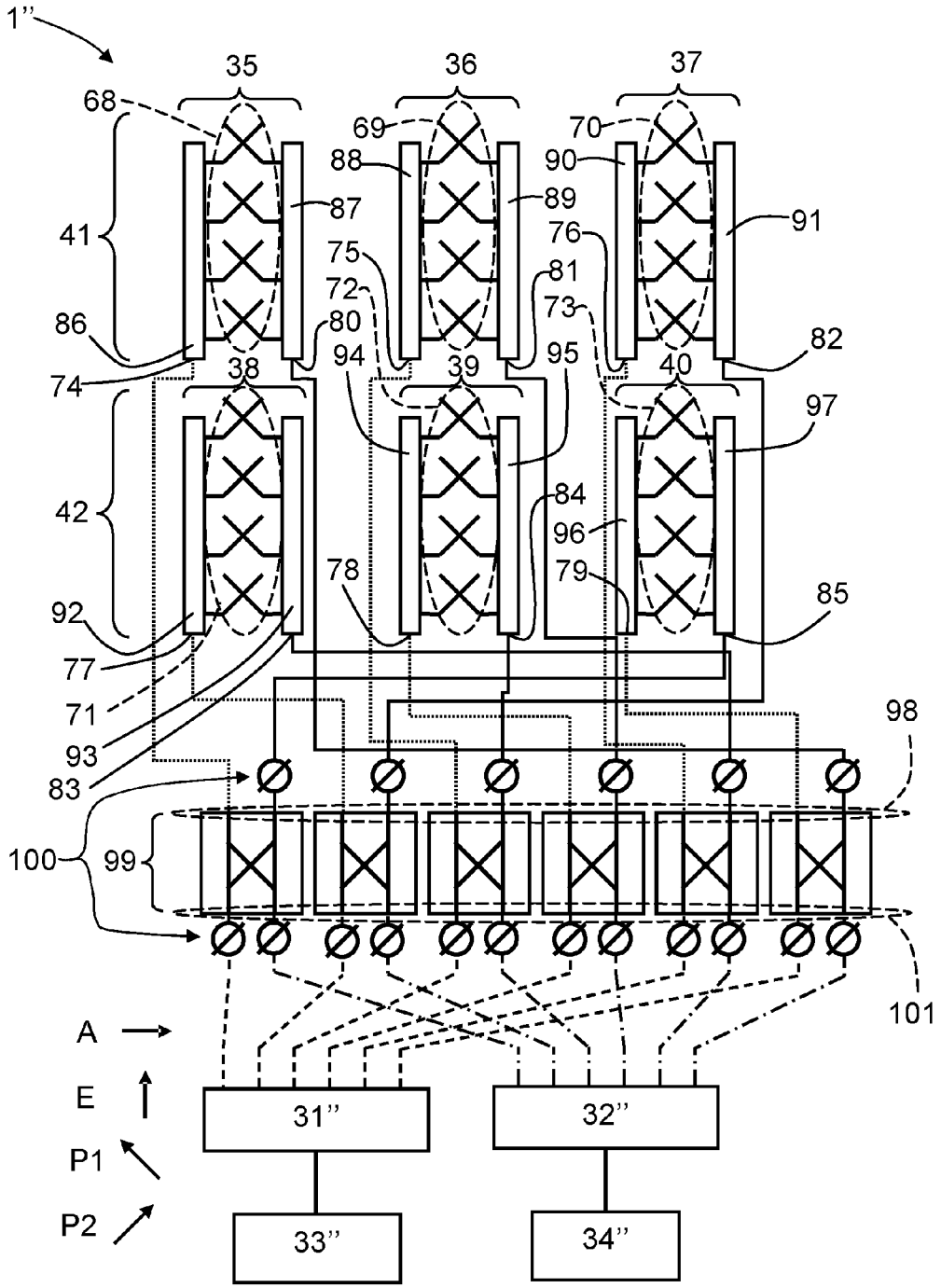
FIG. 4 shows a node according to the present invention present invention with three antenna columns in a first row and three antenna columns in a second row.

With reference to FIG. 4, a third example will be described.

Here a node 1"comprises a first antenna column 35, a second antenna column 36 and a third antenna column 37 in a first row 41 and a first antenna column 38, a second antenna column 39 and a third antenna column 40 in a second row 42. The rows 41, 42 are mutually aligned and extend in the azimuth direction. The rows 41, 42 are furthermore separated from each other in the elevation direction E.

Each antenna column 35, 36, 37; 38, 39, 40 comprises four dual polarized antenna elements 68, 69, 70; 71, 72, 73 that are connected to corresponding first and second antenna ports 74, 75, 76, 77, 78, 79; 80, 81, 82, 83, 84, 85 via corresponding distribution networks 86, 87, 88, 89, 90, 91, 92, 93, 94, 95, 96, 97. The antenna ports 74, 75, 76, 77, 78, 79; 80, 81, 82, 83, 84, 85 are cross-wise connected to first port pairs 98 in corresponding hybrids 99, such that each first port pair 98 is associated with orthogonal polarizations P1, P2 of different antenna columns 35, 36, 37; 38, 39, 40.

In this example, the general symmetry of the present invention is clearly evident, where antenna ports 74, 75, 76, 77, 78, 79; 80, 81, 82, 83, 84, 85 of antenna columns 35, 36, 37; 38, 39, 40 that are pair-wise physically separated, from those pairs of antenna columns with antenna columns 35, 40; 37, 38 that are most physically separated to those pairs of antenna columns 36, 39 with antenna columns that are least physically separated, in a falling order, are cross-wise connected to the first port pair 98 in corresponding hybrids 99.

The first antenna ports 74, 75, 76, 77, 78, 79, associated with the first polarization P1, are connected to the respective hybrid 99 by means of connections that are indicated with respective dotted lines. The second antenna ports 80, 81, 82, 83, 84, 85, associated with the second polarization P2, are connected to the respective hybrid 99 by means of connections that are indicated with respective solid lines.

All hybrids 99 are each equipped with a set 100 of phase altering devices in the same way as for the second hybrid 11 in the first example. The arrows in FIG. 4 indicating the phase altering devices 100 are intended to indicate all phase altering devices shown, forming two rows in the Figure.

Furthermore, one port in corresponding second port pairs 101 of the hybrids 99 are connected to a first power dividing/combining network 31" via respective connections that are indicated with dashed lines. In the same way, the other port in the corresponding second port pairs 101 are connected to a second power dividing/combining network 32" via respective connections that are indicated with dashed-dotted lines.

The power dividing/combining networks 31", 32" are of the type six-to-one, having a respective main input/output port 33", 34". Preferably the dividing/combining networks 31", 32" are constituted by beam forming networks shaping the beams in the azimuth direction A.

In the present invention, all elements in each column are fed with identical elevation networks, and the columns are then connected in pairs to two output ports of hybrids with adjustable phase shifters on at least one the output ports. The two input ports of each hybrid are then individually connected to beam forming networks shaping the beams in the azimuth direction. Thus all elements in the array will be fed when feeding each port of the network, and distance between fed elements will decrease compared to prior art.

The general implementation is an antenna array with dual polarized elements arranged in rectangular grid with a number N of columns, each with the number M elements. For simplicity, all element patterns are assumed to be identical in magnitude and to be pair wise orthogonally polarized in every direction, the only difference between the elements with the same polarization is their different phase centers.

The principal behind the invention is that 2 ports of the antenna generate two patterns that are identical in magnitude and with orthogonal polarizations in every direction.

In the following, a mathematical description for a number of examples will be provided. The first polarization P1 will here be referred to as polarization 1, and the second polarization P2 will here be referred to as polarization 2.

Let $$A_{m,n}^{p}(\theta,\phi)=A^{p}(\theta,\phi)e^{jk(nd_z\cos\theta+md_y\sin\theta\sin\phi)}$$

denote the element pattern of antenna element number n in column m with polarization p, where $$|A^1(\theta,\phi)|=|A^2(\theta,\phi)| \text{ and } A^1(\theta,\phi)A^2(\theta,\phi)^*=0$$

in every direction.

Forming elevation patterns $$B_m^p(\theta,\varphi)=\sum_n w_n A_{m,n}^p(\theta,\varphi)$$

with identical weights $w_n$ will render orthogonal patterns $$B_m^p(\theta,\phi)=B^p(\theta,\phi)e^{jkmd_y\sin\theta\sin\phi}$$

in every direction with $$B^p(\theta,\varphi)=A^p(\theta,\varphi)\sum_n w_n e^{jknd_z\cos\theta}.$$

The patterns $$C_1(\theta,\varphi)=\sum_m u_{1,m}^1 B^1(\theta,\varphi)e^{jkmd_y\sin\theta\sin\varphi}+\sum_m u_{1,m}^2 B^2(\theta,\varphi)e^{jkmd_y\sin\theta\sin\varphi}$$

$$\text{and } C_2(\theta,\varphi)=\sum_m u_{2,m}^1 B^1(\theta,\varphi)e^{jkmd_y\sin\theta\sin\varphi}+\sum_m u_{2,m}^2 B^2(\theta,\varphi)e^{jkmd_y\sin\theta\sin\varphi}$$

are now formed.

Requiring $$C_1(\theta,\phi)C_1(\theta,\phi)^*=C_2(\theta,\phi)C_2(\theta,\phi)^* \text{ and } C_1(\theta,\phi)C_2(\theta,\phi)^*=0$$

for every angle results in following conditions:

$$\sum_{m=1}^{M-l} u_{1,m}^1 u_{1,m+l}^{1*}+\sum_{m=1}^{M-l} u_{1,m}^2 u_{1,m+l}^{2*}=\sum_{m=1}^{M-l} u_{2,m}^1 u_{2,m+l}^{1*}+\sum_{m=1}^{M-l} u_{2,m}^2 u_{2,m+l}^{2*},$$

$$\sum_{m=1}^{M-l} u_{1,m}^1 u_{2,m+l}^{1*}+\sum_{m=1}^{M-l} u_{1,m}^2 u_{2,m+l}^{2*}=0, \text{ and}$$

$$\sum_{m=1}^{M-l} u_{1,m+l}^1 u_{2,m}^{1*}+\sum_{m=1}^{M-l} u_{1,m+l}^2 u_{2,m}^{2*}=0 \text{ for } l=0\ \ldots\ M-1.$$

Those conditions can be met by connecting hybrids between polarization 1 of column m and polarization 2 of column M−n. A typical implementation of a hybrid is a branch-line directional coupler as described above, which easily can be constructed in micro strip or strip line technique and there are several kinds available on the market.

The example with reference to FIG. 2, M=2, will now be mathematically described.

Inserting l=1 renders $$u_{1,1}^1 u_{1,2}^{1*}+u_{1,1}^2 u_{1,2}^{2*}=u_{2,1}^1 u_{2,2}^{1*}+u_{2,1}^2 u_{2,2}^{2*},$$

$$u_{1,1}^1 u_{2,2}^{1*}+u_{1,1}^2 u_{2,2}^{2*}=0 \text{ and}$$

$$u_{1,2}^1 u_{2,1}^{1*}+u_{1,2}^2 u_{2,1}^{2*}=0,$$

and inserting l=0 renders $$u_{1,1}^1 u_{1,1}^{1*}+u_{1,2}^1 u_{1,2}^{1*}+u_{1,1}^2 u_{1,1}^{2*}+u_{1,2}^2 u_{1,2}^{2*}=u_{2,1}^1 u_{2,1}^{1*}+u_{2,2}^1 u_{2,2}^{1*}+u_{2,1}^2 u_{2,1}^{2*}+u_{2,2}^2 u_{2,2}^{2*}$$

and $$u_{1,1}^1 u_{2,1}^{1*}+u_{1,2}^1 u_{2,2}^{1*}+u_{1,1}^2 u_{2,1}^{2*}+u_{1,2}^2 u_{2,2}^{2*}=0,$$

respectively.

Connecting a 90° hybrid between polarization 1 of column 1 and polarization 2 of column 2 and exciting the input ports with $v_1$ and $v_1$ respectively will render $$u_{1,1}^1=1/\sqrt{2}v_1, u_{1,2}^2=j1/\sqrt{2}v_1, u_{2,1}^1=j1/\sqrt{2}v_1 \text{ and}$$

$$u_{2,2}^2=1/\sqrt{2}v_1.$$

Connecting another 90° hybrid between polarization 2 of column 1 and polarization 2 of column 1 and exciting the input ports with $v_2e^{j\beta_{12}}$ and $v_2e^{j\beta_{22}}$ respectively will render $$u_{1,2}^1=1/\sqrt{2}v_2e^{j\beta_{12}}, u_{1,1}^2=j1/\sqrt{2}v_2e^{j(\alpha_2+\beta_{12})}, u_{2,2}^1=j1/\sqrt{2}v_2e^{j\beta_{22}} \text{ and}$$

$$u_{2,1}^2=1/\sqrt{2}v_2e^{j(\alpha_2+\beta_{22})}.$$

Hence $$u_{1,1}^1 u_{2,2}^{1*}+u_{1,1}^2 u_{2,2}^{2*}=\tfrac{1}{2}(-jv_1v_2^*e^{-j\beta_{22}}+jv_2v_1^*e^{j(\alpha_2+\beta_{12})})=0 \text{ and}$$

$$u_{1,2}^1 u_{2,1}^{1*}+u_{1,2}^2 u_{2,1}^{2*}=\tfrac{1}{2}(-jv_2v_1^*e^{j\beta_{12}}+jv_1v_2^*e^{-j(\alpha_2+\beta_{22})})=0,$$

if $v_1v_2^*=v_2v_1^*$ and $\alpha_2=-(\beta_{12}+\beta_{22})$.

Similarly, $$u_{1,1}^1 u_{1,2}^{1*}+u_{1,1}^2 u_{1,2}^{2*}=\tfrac{1}{2}(v_1v_2^*e^{-j\beta_{12}}+v_2v_1^*e^{j(\alpha_2+\beta_{12})}) \text{ and}$$

$$u_{2,1}^1 u_{2,2}^{1*}+u_{2,1}^2 u_{2,2}^{2*}=\tfrac{1}{2}(v_1v_2^*e^{-j\beta_{22}}+v_2v_1^*e^{j(\alpha_2+\beta_{22})})$$

are equal under the same conditions.

Furthermore are $$u_{1,1}^1 u_{1,1}^{1*}+u_{1,2}^1 u_{1,2}^{1*}+u_{1,1}^2 u_{1,1}^{2*}+u_{1,2}^2 u_{1,2}^{2*}=v_1v_1^*+v_2v_2^*=u_{2,1}^1 u_{2,1}^{1*}+u_{2,2}^1 u_{2,2}^{1*}+u_{2,1}^2 u_{2,1}^{2*}+u_{2,2}^2 u_{2,2}^{2*} \text{ and}$$

$$u_{1,1}^1 u_{2,1}^{1*}+u_{1,2}^1 u_{2,2}^{1*}+u_{1,1}^2 u_{2,1}^{2*}+u_{1,2}^2 u_{2,2}^{2*}=0$$

irrespective of choice of phases, since we are using hybrids.

The total envelope $$C_1(\theta,\phi)C_1(\theta,\phi)^*+C_2(\theta,\phi)C_2(\theta,\phi)^*$$

is then given by $$2B^1(\theta,\phi)B^1(\theta,\phi)^*(v_1^2+v_2^2+\tfrac{1}{2}v_1v_2(e^{-j\beta_{12}}+e^{-j\beta_{22}})e^{j\delta}+\tfrac{1}{2}v_1v_2(e^{j\beta_{12}}+e^{j\beta_{22}})e^{-j\delta}),$$

which can rewritten as $$2B^1(\theta,\varphi)B^1(\theta,\varphi)^*\left(v_1^2+v_2^2+2v_1v_2\cos\left(\frac{\beta_{12}-\beta_{22}}{2}\right)\cos\left(\delta-\frac{\beta_{12}-\beta_{22}}{2}\right)\right).$$

This means that we chose $v_1=v_2=1/\sqrt{2}$ and still obtain all available degrees of freedom of the envelope.

Let $v_1=\cos a$ and $v_2=\sin a$, and write the envelope as $$1+\sin 2a\cos\left(\frac{\beta_{12}-\beta_{22}}{2}\right)\cos\left(\delta-\frac{\beta_{12}-\beta_{22}}{2}\right)$$

i.e. using $$a=\pi/4 \text{ and } \frac{\beta_{12}-\beta_{22}}{2}$$

is equivalent to using $$a = \pi/4 - \frac{\beta_{12} - \beta_{22}}{4} \text{ and } \frac{\beta_{12} - \beta_{22}}{2} = 0,$$

$$\text{or } v_1 = 1/\sqrt{2}\left(\cos\frac{\beta_{12} - \beta_{22}}{4} + \sin\frac{\beta_{12} - \beta_{22}}{4}\right) \text{ and}$$

$$v_2 = 1/\sqrt{2}\left(\cos\frac{\beta_{12} - \beta_{22}}{4} - \sin\frac{\beta_{12} - \beta_{22}}{4}\right).$$

The example with reference to FIG. 3, M=3, will now be mathematically described.

Using the previous result we can make an attempt to connect the outer columns of different polarizations with hybrids and the two polarizations of center column with a third hybrid. We can use the phases of the input and out ports of the central hybrid as a reference without loss of generality.

Based on the conclusion above, the following is stated:

Excitations on the left input ports on all hybrids:

$$ae^{j\beta_{11}}, 1, ae^{j\beta_{13}}$$

and on the right $$ae^{j\beta_{12}}, 1, ae^{j\beta_{23}}$$

and adjustable phase shifters $$e^{j+1}, 1, e^{j\alpha_3}$$

on the output port for polarization 2 render the following excitations:

$$ae^{j\beta_{11}}, 1, ae^{j\beta_{13}}, jae^{j(\alpha_3+\beta_{13})}, j, jae^{j(\alpha_1+\beta_{11})} \text{ for port 1, and}$$

$$jae^{j\beta_{21}}, j, jae^{j\beta_{23}}, ae^{j(\alpha_3+\beta_{23})}, 1, ae^{j(\alpha_1+\beta_{21})} \text{ for port 2,}$$

or $$ae^{j\beta_{11}}, 1, ae^{j\beta_{13}}, jae^{-j\beta_{23}}, j, jae^{-j\beta_{21}} \text{ and}$$

$$jae^{j\beta_{21}}, j, jae^{j\beta_{23}}, ae^{-j\beta_{13}}, 1, ae^{-j\beta_{11}} \text{ with}$$

$$\alpha_1 = -(\beta_{11}+\beta_{21}) \text{ and } \alpha_3 = -(\beta_{13}+\beta_{23}).$$

The conditions for l=2, $$u_{1,1}{}^1 u_{1,3}{}^{1*} + u_{1,1}{}^2 u_{1,3}{}^{2*} = \tfrac{1}{2}a^2(e^{j(\beta_{11}-\beta_{13})} + e^{j(\beta_{21}-\beta_{23})}) \text{ and}$$

$$u_{2,1}{}^1 u_{2,3}{}^{1*} + u_{2,1}{}^2 u_{2,3}{}^{2*} = \tfrac{1}{2}a^2(e^{j(\beta_{21}-\beta_{23})} + e^{j(\beta_{11}-\beta_{13})}) \text{ are thus fulfilled.}$$

$$\text{Also } u_{1,1}{}^1 u_{2,3}{}^{1*} + u_{1,1}{}^2 u_{2,3}{}^{2*} = -ja^2 e^{j(-\beta_{23}+\beta_{11})} = 0.$$

The conditions for l=1 are then $$u_{1,1}{}^1 u_{1,2}{}^{1*} + u_{1,2}{}^1 u_{1,3}{}^{1*} + u_{1,1}{}^2 u_{1,2}{}^{2*} + u_{1,2}{}^2 u_{1,3}{}^{2*} = ae^{j\beta_{11}} + ae^{-j\beta_{13}} + ae^{-j\beta_{23}} + ae^{j\beta_{21}}$$

which is equal to $$u_{2,1}{}^1 u_{2,2}{}^{1*} + u_{2,2}{}^1 u_{2,3}{}^{1*} + u_{2,1}{}^2 u_{2,2}{}^{2*} + u_{2,2}{}^2 u_{2,3}{}^{2*}.$$

Furthermore are $$u_{1,1}{}^1 u_{2,2}{}^{1*} + u_{1,2}{}^1 u_{2,3}{}^{1*} + u_{1,1}{}^2 u_{2,2}{}^{2*} + u_{1,2}{}^2 u_{2,3}{}^{2*} = -jae^{j\beta_{11}} + jae^{-j\beta_{23}} - jae^{-j\beta_{23}} + jae^{j\beta_{11}} = 0,$$

and similarly $$u_{2,1}{}^1 u_{1,2}{}^{1*} + u_{2,2}{}^1 u_{1,3}{}^{1*} + u_{2,1}{}^2 u_{1,2}{}^{2*} + u_{2,2}{}^2 u_{1,3}{}^{2*} = 0.$$

Hence also all conditions those conditions are fulfilled.

The total envelop is given by $$B^1(\theta,\phi)B^1(\theta,\phi)^*(2+4a^2+a(e^{j\beta_{11}}+e^{-j\beta_{13}}+e^{-j\beta_{23}}+e^{j\beta_{21}})e^{j\delta}+a(e^{-j\beta_{11}}+e^{j\beta_{13}}+e^{j\beta_{23}}+e^{-j\beta_{21}})e^{-j\delta}+a^2(e^{j(\beta_{11}-\beta_{13})}+e^{j(\beta_{21}-\beta_{23})})e^{j2\delta}+a^2(e^{-j(\beta_{11}-\beta_{13})}+e^{-j(\beta_{21}-\beta_{23})})e^{-j2\delta}).$$

Normalizing to input power and setting all phases equal to 0 returns the max available peak power $$\frac{2+8a+8a^2}{2+4a^2} = \frac{(1+2a)^2}{1+2a^2}$$

which has its maximum 3 for a=1.

The resulting envelope is then $$1+4/3\cos\delta+2/3\cos 2\delta.$$

Choosing a=1 and e.g. $\beta_{11}=\beta_{13}=\beta_{21}=\beta_{23}=\pi/2$ will make the terms with $e^{j\delta}$ and $e^{-j\delta}$ disappear giving the envelope $1+2/3\cos 2\delta$ and by choosing $$\beta_{11}=\beta_{23}=\pi/4 \text{ and } \beta_{21}=\beta_{13}=-\pi/4$$

only the constant remains.

Regarding an arbitrary number of columns, generally, by applying phase shifts according to above rule $$\alpha=-(\beta_1+\beta_2),$$

and connecting the output ports of polarization 2 in reverse order of the output ports of polarization 1 will produce an excitation vector of polarization 2 for port 1 that is proportional to the reversed and conjugated vector of polarization 1 of port 2, giving the same power amplitude.

Having several rows, as shown in FIG. 4, the excitations for port 1 in a single vector are ordered with row 1 first and row 2 second etc., e.g.

$$U^1{}_1=(u^1{}_{111}, u^1{}_{112}, u^1{}_{121}, u^1{}_{122}).$$

Reversing the order and conjugating gives the excitations for polarization 2 of port 2 as $$U^2{}_2=j(u^1{}_{122}{}^*, u^1{}_{121}{}^*, u^1{}_{112}{}^*, u^1{}_{111}{}^*).$$

Applying the steering vector $$W=(w_y, w_z, w_y{}^2 w_z, w_y w_z{}^2, w_y{}^2 w_z{}^2) = w_y{}^3 w_z{}^3 (w_y{}^{-2} w_z{}^{-2}, w_y{}^{-1} w_z{}^{-2}, w_y{}^{-2} w_z{}^{-1}, w_y{}^{-1} w_z{}^{-1})$$

with $w_y=e^{jkd_y \sin\theta \sin\phi}$ and $w_z=e^{jkd_z \cos\theta}$, will render $$U^2{}_2 W^T = j w_y{}^3 w_z{}^3 (U^1{}_1 W^T)^* \text{ and thus } |U^1{}_1 W^T|^2 = |U^2{}_2 W^T|^2.$$

Similarly we find that $$U^2{}_1=-j(u^1{}_{222}{}^*, u^1{}_{221}{}^*, u^1{}_{212}{}^*, u^1{}_{211}{}^*), \text{ and hence}$$

$$U^2{}_1 W^T = -j w_y{}^3 w_z{}^3 (U^1{}_2 W^T)^*, \text{ and thereby}$$

$$C_1C_2{}^* = (U^1{}_1 W^T B^1 + U^2{}_1 W^T B^2)(U^1{}_2 W^T B + U^2{}_2 W^T B^2)^* = U^1{}_1 W^T (U^1{}_2 W^T)^* B^1 B^{1*} + U_2{}^1 W^T (U^2{}_2 W^T)^* B^2 B^{2*} = (U^1{}_1 W^T (U^1{}_2 W^T)^* - (U^1{}_2 W^T)^* U^1{}_1 W^T) B^1 B^{1*} = 0,$$

since $B^1B^{1*}=B^2B^{2*}$ and $B^1B^{2*}=0$.

That is, by connecting output port 2 of the hybrid with output port 1 connected to the sub array with polarization 1 in row n and column m to the element to the sub array with polarization 2 in row N−n+1 and column M−m+1, we will get patterns from the two ports which have orthogonal polarizations and equal envelope in all direction assuming that all patterns from the sub arrays are identical in envelope but pair-wise orthogonal in polarization.

The present invention is not limited to the examples above, but may vary freely within the scope of the appended claims. For example, the role of the columns and rows can be interchanged.

The technique of polarization beam shaping can be used on forming the elevation patterns as well, since they will produce columns that are orthogonally polarized everywhere.

The aperture can be dived into subareas, each with fixed identical distribution networks.

The relations for the phase shifts are per hybrid basis; hence a hybrid and the attached phase shifters can be designed as a unit, which could be replicated.

Instead of forming the elevation patterns in advance, the elements can be connected crosswise, polarization P1 of element m,n to polarization P2 of element M+1−n, N+1−n with hybrids and maintaining the relation $\alpha=-(\beta_1+\beta_2)$ for the phase shifters connected to each hybrid.

Regarding the placement of the phase shifters on the hybrids following can be considered:

The phase shifter on polarization port 2 can be moved to polarization port 1 instead with the same values the phase shifters.

The phase shifter of input port 1 could be moved to polarization port 1 by requiring $\alpha'_1=\beta_1$ and adjusting the values of the others as $\alpha'_2=-\beta_2$ and $\beta'_2=\beta_2-\beta_1$.

The hybrids may be any suitable type of four-port power dividers/combiners, such as for example a so-called rat-race hybrid.

The hybrids need not have equal power division/combining properties between the ports in a port pair.

The antenna columns need not be separated in the azimuth direction A, but may be separated in the elevation direction only, constituting a single row. The antenna columns may be oriented in any suitable way, for example they may be facing the sky such that the lie perpendicular to the ground.

An antenna column need to comprise at least one dual polarized antenna element.

Any number of sets of phase altering devices may exclude the first phase altering device, which thus is not present, for the special case where the sum of the setting of the second phase altering device $\beta_2$ and the setting of the third phase altering device $\beta_{22}$ equals 0. In this case the beams have fixed directions but with adjustable beam-width.

The terms lobe and beam both relate to the antenna radiation characteristics.

When terms like orthogonal are used, they are not to be interpreted as mathematically exact, but within what is practically obtainable.

The polarizations may have any directions, but should always be orthogonal.

The invention claimed is:

1. A node in a wireless communication network, the node comprising:

at least two antenna columns which are physically separated from each other, each antenna column comprising at least one dual polarized antenna element, each antenna element having a first polarization and a second polarization, the first polarization and second polarization being mutually orthogonal, such that each antenna column comprises a first antenna port, associated with the first polarization, and a second antenna port, associated with the second polarization; and at least two four-port power dividers/combiners, each power divider/combiner having a first port pair and a second port pair, where, for each power divider/combiner, power input into any port in a port pair is isolated from the other port in said port pair, but divided between the ports in the other port pair, where antenna ports of antenna columns that are pair-wise physically separated, from those pairs of antenna columns with antenna columns that are most physically separated to those pairs of antenna columns with antenna columns that are least physically separated, in a falling order, are cross-wise connected to the first port pair in corresponding power dividers/combiners, such that each first port pair is associated with orthogonal polarizations of different antenna columns, wherein for at least one power divider/combiner, the ports in the second port pair are connected to a corresponding second phase altering device and third phase altering device, the phase altering devices that are connected to a certain power divider/combiner constituting a set of phase altering devices, and where one port in each second port pair is connected to a first power dividing/combining network and the other port in each second port pair is connected to a second power dividing/combining network each power dividing/combining network having a respective main input/output port.

2. A node according to claim 1, wherein one port in the first port pair that is associated with a certain polarization is connected to the corresponding antenna port via a first phase altering device, the phase altering devices that are connected to a certain power divider/combiner constituting a set of phase altering devices.

3. A node according to claim 2, wherein for each set of phase altering devices, the setting of the first phase altering device equals the sum of the setting of the second phase altering device and the setting of the third phase altering device.

4. A node according to claim 1, wherein the antenna columns have respective main extensions in an elevation direction.

5. A node according to claim 4, wherein the antenna columns are separated in either an azimuth direction or the elevation direction, the azimuth direction and the elevation direction being mutually orthogonal.

6. A node according to claim 5, wherein, in the case of an odd number of antenna columns, the antenna ports of the central antenna column are connected to the same power divider/combiner.

7. A node according to claim 4, wherein the antenna columns are arranged in at least two aligned rows, each row extending in an azimuth direction and having the same number of antenna columns, the rows being separated from each other in the elevation direction, the azimuth direction and the elevation direction being mutually orthogonal.

8. A node according to claim 1, wherein, for each power divider/combiner, power input into any port in a port pair is divided equally between the ports in the other port pair.

* * * * *